US005457924A

United States Patent [19]

Fujii et al.

[11] Patent Number: 5,457,924

[45] Date of Patent: Oct. 17, 1995

[54] SLATE ROOFING MATERIAL JOINT AND SLATE ROOF STRUCTURE USING THE JOINT

[76] Inventors: Keizou Fujii, Ho-1, Machida-Kiso-Jutaku, 2379 Hon-Machida, Machida-city, Tokyo; Ikuji Ono, 3-34-4, Taitoh, Taitoh-ku, Tokyo, both of Japan

[21] Appl. No.: 212,826

[22] Filed: Mar. 15, 1994

[51] Int. Cl.[6] ..... E04D 1/36

[52] U.S. Cl. ..... 52/396.1; 52/533; 52/553

[58] Field of Search ..... 52/518, 533, 553, 52/409, 459, 540, 58, 394, 396.04, 396.1

[56] References Cited

U.S. PATENT DOCUMENTS 5,148,644 9/1992 Weir ..... 52/58 X

FOREIGN PATENT DOCUMENTS 2026058 7/1978 United Kingdom .

*Primary Examiner*—Carl D. Friedman
*Assistant Examiner*—Yvonne Horton-Richardson
*Attorney, Agent, or Firm*—Oblon, Spivak, McClelland, Maier & Neustadt

[57] ABSTRACT

A slate roofing material joint having a flat strip-shaped mounting base plate made of weatherproof soft resin. A pair of flat-based plates, which are also weatherproof, but are made of hard resin, are connected to the sides of the mounting base plate. Several water-guide protruding strips run along the base plates and edge flashings made of weatherproof soft resin are formed at the outer edge of the base plates. A portion of the edge flashings are bent upward and curved inward with an edge thickness that progressively declines for elastically supporting roofing material. The entire structure forms an integral unit made of weatherproof soft and hard resins for carrying away water, which has seeped through the roofing material, out from under the roofing material.

12 Claims, 5 Drawing Sheets

SLATE ROOFING MATERIAL JOINT AND SLATE ROOF STRUCTURE USING THE JOINT

BACKGROUND OF THE INVENTION

1. Field of the Invention

This invention concerns slate roofing material joints and the structure of slate roofs using such slate roofing material joints as slate roof tiling technology.

2. Prior Art

Description of the Related Art

When tiling roofs using flat slate roofing tiles as roofing, the work was done as shown in conventional FIG. 6.

That is to say, the flat roofing tiles 52 were installed with two-thirds of the pieces of roofing material overlapping in the direction of the slope on top of the waterproof sheet 51 laid on the roof backing 50. As can be seen from the sectional view given in the figure, with that structure three flat slate roofing tiles 52, always overlap in the cross-sectional direction on completion of the tiling.

With the conventional slate roof tiling structure mentioned above, the intention is to prevent leakage with a structure of multiple overlapping of flat slate roofing tiles with considerable overlapping. However, that structure cannot be used on roofs with a gentle slope of 35/100 or less.

Furthermore, with the trend in recent years to use higher-class roofing, tiling is now being done with natural slate roofing making use of "genshooseki", and as a result there is not only a slope problem but also the problem of strengthening the supporting roof structure because of the greater load per unit of surface area due to the weight of the "genshooseki". The weight problem is significant especially if the conventional 3-tile overlap structure is used.

In addition, with the conventional 3-tile overlap structure there is the problem of the high cost roofing because of the large number of tiles that have to be used as a result of the considerable overlapping.

SUMMARY OF THE INVENTION

This invention has been made in view of the above problems. Its purpose is to provide a slated roof structure with no leakage problems even to provide a gentle slope, with a small load on the roof supporting structure per unit of surface area and to provide low cost by using a smaller number of tiles for the tiling. This invention also furnishes the slate roofing tile joints to be used for such a slated roof structure.

In addition, this invention also proposes a method of tiling slated roofs using the slate roofing tile joints.

The slate roofing material joint of this invention consists of a flat belt-shaped mounting base plate made of weatherproof soft resin, a pair of planar rectangular flat base plates made of weatherproof hard resin that are symmetrically connected to both sides of that mounting base plate, several water-guide protruding strips laid on top of those two base plates at the same height in the direction in which the mounting base plate runs and edge flashings made of weatherproof soft resin, with a circular section bent upward and curved inward, installed on the side edge outside the two base plates and with a progressively thinner end edge and essentially forms the mounting base plate, the pair of base plates and the pair of edge flashings into an integral whole using weatherproof soft resin and hard resin.

Furthermore, the present invention can be made into a structure with a center line mark in the longitudinal direction in the center of the top face of the mounting base plate.

It is also possible to make minute grooves in the slated roof structure running in the longitudinal direction on the top of the base plates on the inner side of the edge flashings.

The essence of the stated roof structure using slate roofing material joints covered by this invention is the fact that the slate roofing material joint is fixed on top of the lower piece of slate roofing material in correspondence to the position of the joint of the piece of slate roofing material laid in overlapping fashion on top of it and that the upper piece of slate roofing material is laid on top of that with about one-third overlapping and fixed in place.

With the above-mentioned slated roof structure using slate roofing material joints, in view of the fact that it is a structure in which the slate roofing material, a joint is placed between the upper piece of slate roofing material and the lower piece of slate roofing material, a channel is formed by the slate roofing material joint for the water between the joints to run down, and therefore there is no problem of leaks in the roof even if the roof has a gentle slope.

Furthermore, since the amount of overlapping of the slate roofing materials is reduced, the total weight of the roofing material is lighter, and it is not necessary to reinforce the roof structure even if heavy materials such as natural slate tiles are used.

The other features and advantages of this invention are made evident in the following explanation making reference to the annexed figures.

DETAILED DESCRIPTION OF THE PREFERRED EMBODIMENT

The following is an explanation of the preferred embodiment of the slate roofing material joint and the slated roof tiling structure using the slate roofing material joint of this invention.

Figure 1:
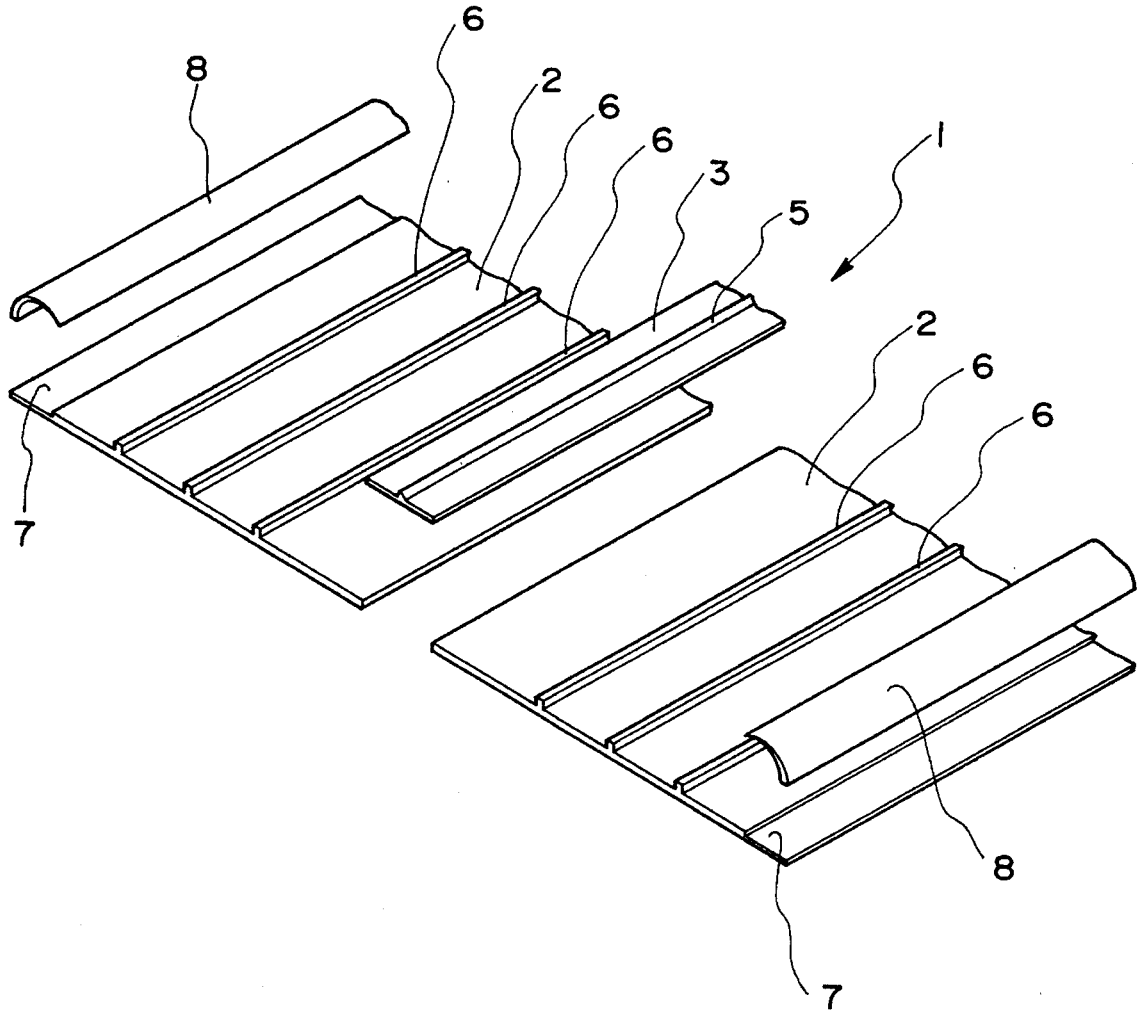
FIG. 1 is a heterotropic drawing separating the slate roofing material joint into soft resin structural parts and hard resin structural parts.
Figure 2:
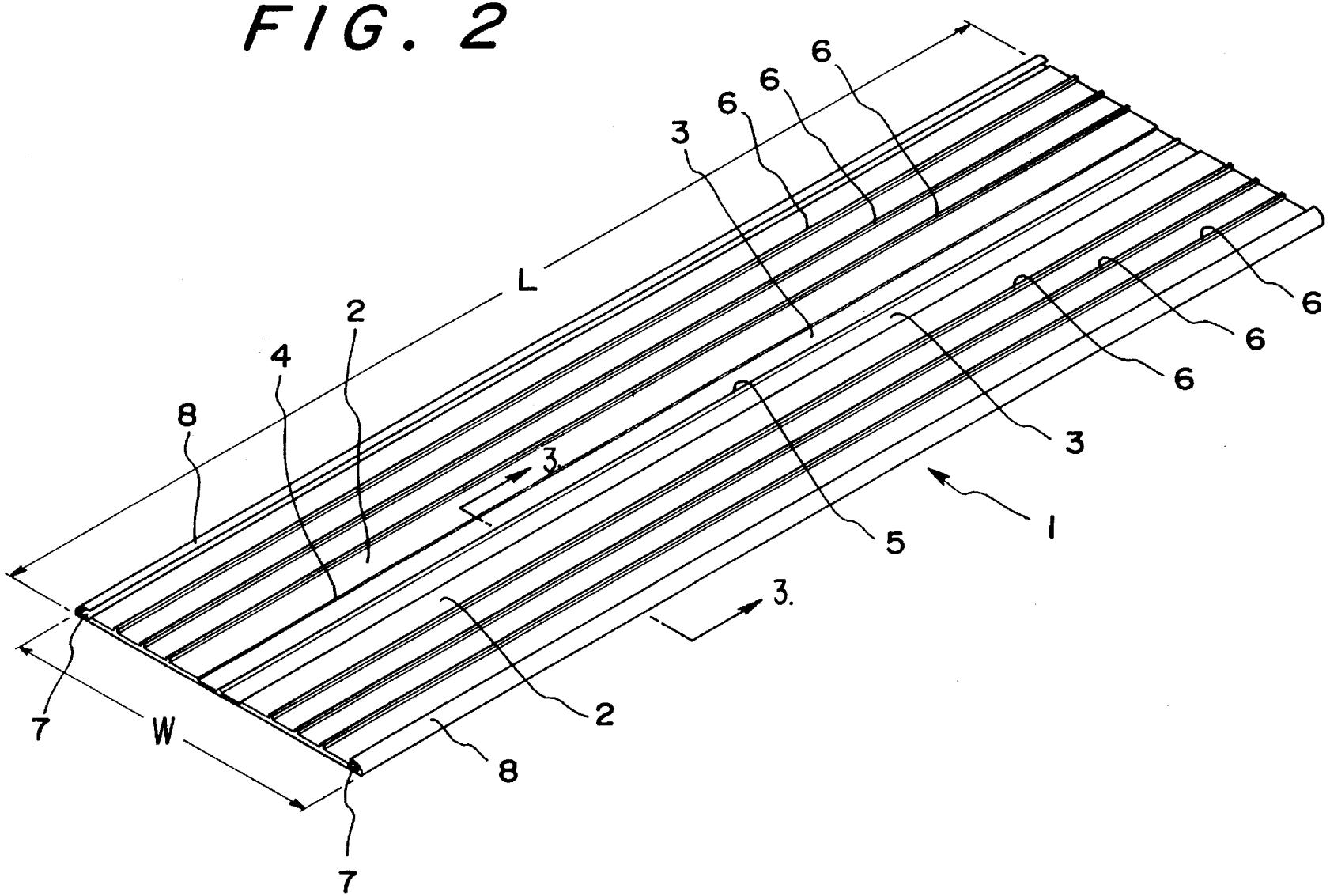
FIG. 2 is a heterotropic drawing of the invention in FIG. 1 assembled.
Figure 3:
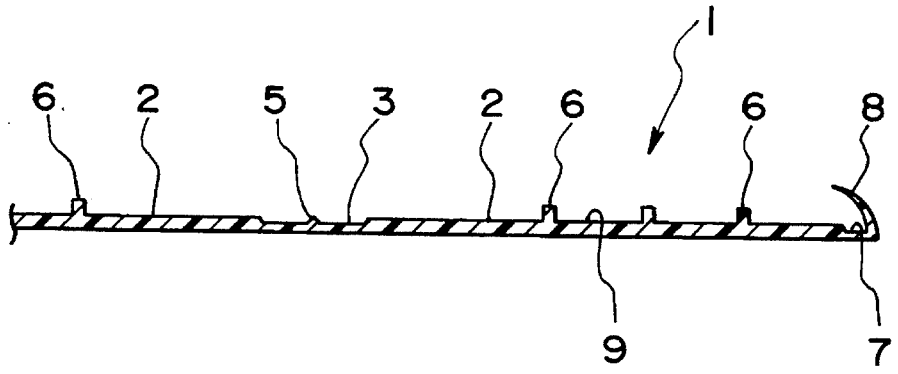
FIG. 3 is an enlarged A—A cross section of FIG. 2.

As shown in FIGS. 1 and 2, the slate roofing material joint 1 is a single unit made of hard resin and soft resin with long-term weatherproof qualities that has the flat outer appearance of a plane 3 with a rectangular form.

The length L of the slate roofing material joint 1 is somewhat longer (approx. 30 cm) than the width in the direction of the slope of the flat slate tiles used. The width W is appropriate (approx. 10 cm) for straddling the pieces of slate roofing material 10 laid side by side.

The rectangular flat base plates 2 are made of weatherproof hard resin and form an integral unit on the respective side edges of the flat strip-shaped mounting base plate 3 made of soft resin, constituting as a whole a flat plate shape. The base plates 2 have a preferable thickness of approx. 0.8 mm, and the mounting base plate 3 has preferable a thickness of approx. 0.6 mm. The integral unit forms a structure with a level difference 4 that makes a groove on the top. On the top of the mounting base plate 3 there is a center line mark 5 forming a small rise (0.4 mm) with an angular section running as a protruding strip along the center in the longitudinal direction.

Furthermore, on the top of the two base plates 2 there are several (3 each in the example of embodiment) water-guide protruding strips 6 etc. running parallel at approximately the same interval and with linear symmetry to the center line mark 5 in the longitudinal direction, each with the same height (approx. 1.7 mm).

At the outside edge of the base plates 2 there soft resin of minute grooves 7 (depth of 0.2 mm) are connected as a continuation of the base plates 2. Edge flashings 8 with a circular section are bent upward from the edge of the two minute grooves 7 and curved inward. The edge flashings 8 have a structure in which the thickness is progressively reduced in the direction of the tip, and, because of the load from above, there is inclination inward in opposition to the elasticity of the resin material.

Figure 4A:
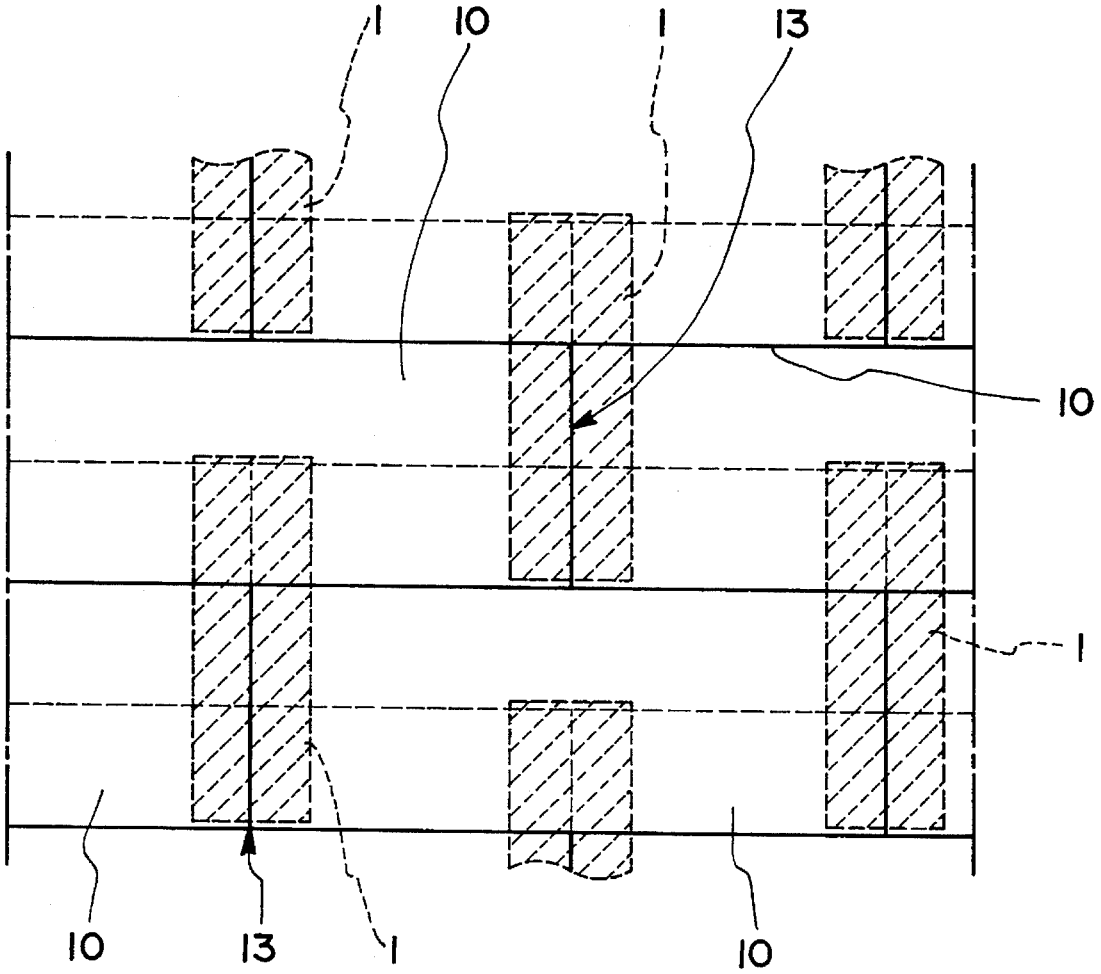
FIGS. 4*a* and 4*b* are a top view (a) and a longitudinal section in the direction of slope (b) of the slated roof tiling structure of this invention.
Figure 4B:
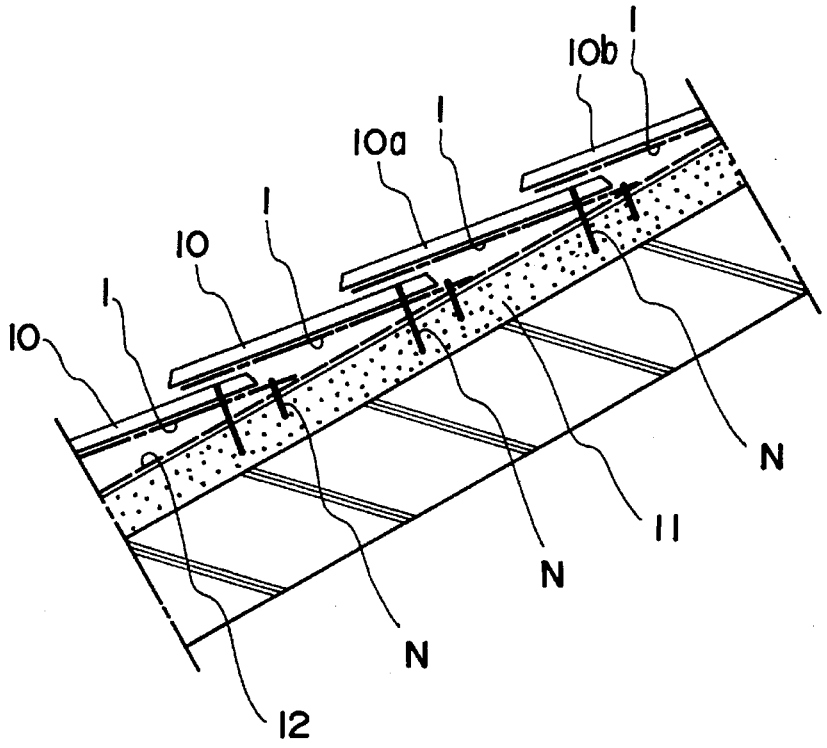

The slate roofing material joint 1 with the composition described above is used for tiling slated roofs as shown in FIG. 4. The flat slate tiles 10 etc. are laid side by side without lateral overlapping on top of the waterproof sheet 12 laid on the roof backing 11. In the direction of the slope, the tiling is done with one-third overlapping of the upper flat **10*b* slate laid on the lower one 10*a* (FIG. 4*b***) in each case.

In so doing, the slate roofing material joint 1 is fixed on top of the lower flat slate tile **10*a* in such a way that the. center line mark 5 is located at the position of the joint 13 between the flat slate tiles 10 laid on top in overlapping fashion and such that the lower edges of those tiles coincide with one another. Such fixing can be done easily without having to first open nail holes because the mounting base plate 3 is made of soft resin and the nail N can be hammered into the roof foundation material 11 through it (FIG. 4*b*). The upper flat slate 10*b* is then laid and fixed on top with one-third overlapping the lower flat slate 10*a* by hammering nails N, etc., into the roof foundation material 11** just as in the case of conventional tiling.

The structure of a slated roof tiled as per the above description is a structure in which the slate roofing material joint 1 is located (as per FIG. 5) between the lower flat slate tile **10*a* and the upper flat slate tiles 10*b* The edge flashings 8 formed at both edges of the slate roofing material joint 1 are inclined inward in opposition to the elasticity of the resin on account of the load of the upper flat tile 10*b* and fit tightly to both the bottom of the upper flat slate tile 10*b* and the bottom of the flat tile 10*b***.

Figure 5:
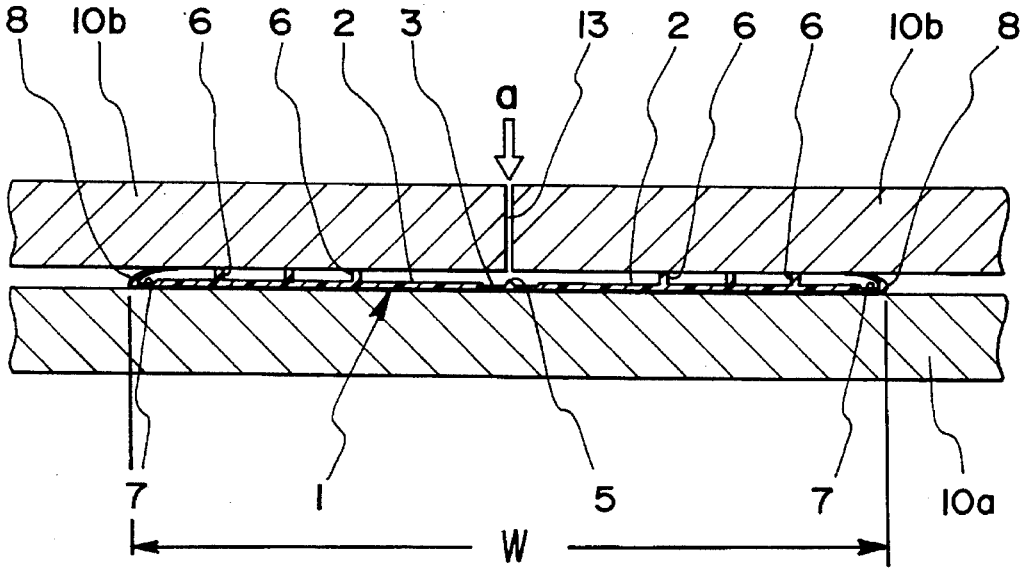
FIG. 5 is a longitudinal section in the lateral direction showing the slated roof tiling structure of this invention
Figure 6:
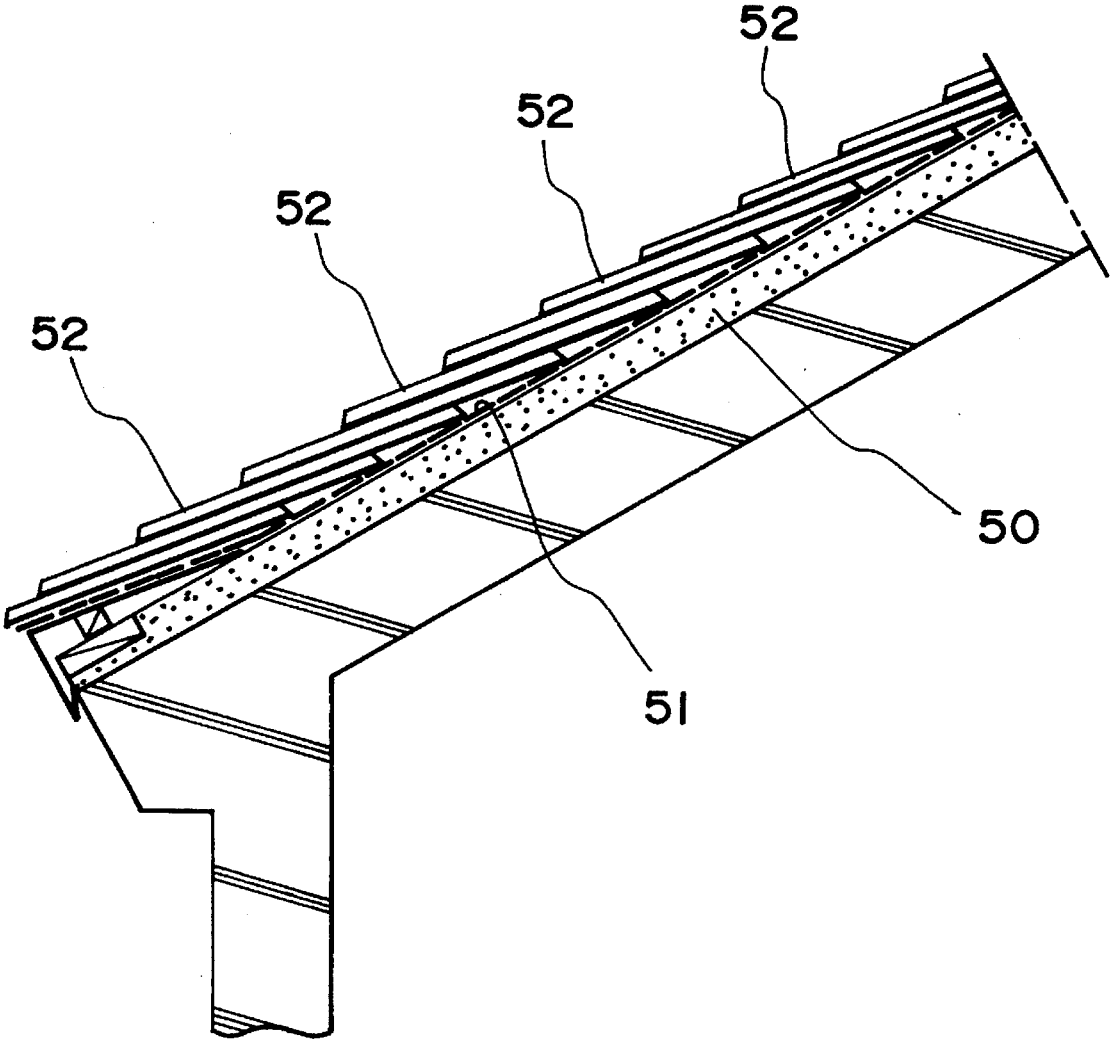
FIG. 6 (PRIOR ART)
FIG. 6 is a longitudinal section showing the conventional slated roof tiling structure.

Because of overlapping of the lower flat slate tile **10*a*, the slate roofing material joint 1 and the upper flat slate tile 10*b* prevented leakage. Beneath the upper flat slate tiles 10*b*, 10*b* and between them are formed channels 9 etc., intersected in the lateral direction by water-guide protruding strips 6, on both sides of the center line mark 5. The edge flashings 8 and the channels of the minute grooves 7 form a seal so that water flows only on the joint 1 and out onto the lower flat slate tile 10*a*, as shown in FIGS. 4*b* and 5. The minute grooves 7 also aid in carrying water. Accordingly, rainwater a which penetrates from between the upper flat slate tiles 10*b*, 10*b* runs down the central channel 9 and out onto the top of the lower flat slate tile 10*a***. As a result, there is no problem of roof leakage even if the roof slope is 30/000 or less.

Furthermore, since the overlapping of the upper slate flat tile **10*b* and the lower slate flat tile 10*a*** is only one-third of the roofing material, the total weight of the roofing material can be reduced to one-half of that in the case of the conventional tiling method. This means that it is possible to lay "genshooseki" and other heavy natural slate roofing materials on the conventional roof foundation structure.

The above is a somewhat detailed explanation of this invention in terms of the most preferable embodiment. Since it is clear that a wide range of different embodiments is possible without violating the idea and scope of this invention, this invention is not limited to that particular embodiment.

I claim:

1. A roofing material joint comprising:

a flat strip-shaped mounting base plate made of continuous weatherproof soft resin;

a pair of flat base plates made of weatherproof hard resin, having a plane rectangular shape and connected to the mounting base plate with the ends of the base plates and the mounting base plate being flush;

several water-guide protruding strips located on the two base plates in the direction in which the mounting base plate runs;

edge flashings made of weatherproof soft resin, located on an outer edge of the two base plates, with a circular section bent upward and curved inward and with an end edge thickness that progressively declines; and wherein the joint forms an integral unit made of weatherproof soft resin and hard resin from the mounting base plate, the pair of base plates and the pair of edge flashings for carrying water, which seeps through adjacent roofing portions, out from under the roofing portions.

2. The roofing material joint of claim 1, further comprising:

a center line mark made in the middle of a top face of the mounting base plate and running in the longitudinal direction for centering said adjacent roofing portions over said joint.

3. The slate roofing material joint of claim 1, further comprising:

minute grooves running in the longitudinal direction formed in a top of the base plates at an inside of the edge flashings.

4. A roof structure using the roofing material joint according to any of claims 1, 2 or 3 wherein the joint is arranged on top of a lower piece of roofing material in correspondence to an adjacent upper piece of roofing material laid above said lower piece in overlapping fashion and fixing the upper piece of roofing material on top of the lower piece with approximately one-third overlapping.

5. A roofing material joint comprising:

a mounting base plate made of a strip of continuous waterproof soft resin;

two flat base plates each made of a strip of continuous waterproof hard resin, each said flat base plate connected to opposite sides of the mounting base plate;

edge flashings each made of soft waterproof resin and formed on an outer perimeter of the two flat base plates opposite the side connecting the flat base plates to the mounting base plate;

hook-shaped, circular sections of the edge flashings for supporting roofing material and forming a seal between the supported roofing material and the joint; and wherein, the mounting base plate, two flat base plates, edge flashings and hook-shaped, circular sections form said roofing material joint which is continuous and prevents water from leaking into a roof by forming a channel for carrying water, which has seeped through the roofing material, along the joint and out from under the roofing material.

6. The apparatus of claim 5, further comprising:

water-guide protruding strips formed along the joint on a surface forming the channel for facing the supported roofing material, and running in a longitudinal direction of a roof for channeling water out from under the roofing material.

7. The apparatus of claim 6, further comprising:

a center line mark centered in the middle of the joint and running in a longitudinal direction to assist the assembly of the roofing material on the joint.

8. A roof structure using the roofing material joint according to claim 7, wherein two pieces of roofing material are placed side by side with an abutment centered on said center line mark such that water seeping through the abutment falls onto a center point of the joint and is carried out from under the roofing material.

9. The apparatus of claim 8, wherein the mounting base plate forms a depression between the flat base plates for carrying additional water.

10. The apparatus of claim 9, further comprising:

minute grooves at the point where the edge flashings connect to the flat base plates for further channeling water out from under the roofing material.

11. The apparatus of claim 10, wherein the joint is rectangular and has even sides.

12. A roof structure using the roofing material joint according to claim 5, further comprising:

a plurality said roofing material joints fixed between layers of overlapping pieces of roofing material, wherein the overlapping portions of the roofing material do not exceed one-third of each piece of said overlapping roofing material.

* * * * *